United States Patent [19]

Kanno

[11] Patent Number: 4,989,575

[45] Date of Patent: Feb. 5, 1991

[54] IGNITION DEVICE FOR INTERNAL COMBUSTION ENGINE

[75] Inventor: Isao Kanno, Hamamatsu, Japan

[73] Assignee: Sanshin Kogyo Kabushiki Kaisha, Hamamatsu, Japan

[21] Appl. No.: 278,860

[22] Filed: Dec. 2, 1988

[30] Foreign Application Priority Data

Dec. 2, 1987 [JP] Japan ..... 62-303234

[51] Int. Cl.[5] ..... F02P 3/02

[52] U.S. Cl. ..... 123/635; 123/169 PA

[58] Field of Search ..... 123/635, 634, 169 PA, 123/647; 315/57

[56] References Cited

U.S. PATENT DOCUMENTS

| | | | |
|---|---|---|---|
| 995,400 | 6/1911 | Cavanagh | 123/635 |
| 1,011,884 | 12/1911 | Cavanagh | 123/169 PA |
| 3,716,038 | 2/1973 | Bevacqua | 123/635 |
| 3,935,852 | 2/1976 | Donovan et al. | 123/635 |
| 4,446,842 | 5/1984 | Iwasaki | 123/634 |
| 4,461,264 | 7/1984 | Iwasaki | 123/635 |
| 4,514,712 | 4/1985 | McDougal | 336/96 |
| 4,517,540 | 5/1985 | McDougal | 336/205 |

FOREIGN PATENT DOCUMENTS

| | | | |
|---|---|---|---|
| 59-912165 | 1/1984 | Japan . | |
| 59-185877 | 10/1984 | Japan | 123/635 |
| 60-64417 | 4/1985 | Japan . | |

*Primary Examiner*—Andrew M. Dolinar

*Attorney, Agent, or Firm*—Ernest A. Beutler

[57] ABSTRACT

A number of embodiments of coils for mounting on spark plugs for supplying the voltage for firing the spark plugs. In each embodiment, all operative components are disposed below the upper end of the center electrode terminal of the spark plug for reducing the size requirements of the engine. In some embodiments, the coil is mounted at least in part independently of the spark plug so that the spark plug will not carry the full weight of the coil.

5 Claims, 3 Drawing Sheets

IGNITION DEVICE FOR INTERNAL COMBUSTION ENGINE

BACKGROUND OF THE INVENTION

This invention relates to an ignition device for an internal combustion engine and more particularly to an improved coil and mounting arrangement for such engines.

It has been acknowledged that there are certain advantages in supplying small individual coils mounted adjacent each spark plug of the internal combustion engine for firing that respective spark plug. Although such arrangements have some advantages, the placement of coils in proximity to spark plugs can present certain design problems. This is particularly true in conjunction with compact engine configurations such as are typical in outboard motors. That is, in connection with an outboard motor there is considerable importance in simplicity and compactness of design and the previously proposed coil mounting arrangements where coils are mounted adjacent the individual spark plugs have not been satisfactory for application to outboard motors.

It is, therefore, a principal object to this invention to provide an improved, compact, coil, spark plug arrangement for an internal combustion engine.

It is a further object of this invention to provide an improved mounting arrangement for an individual coil for the spark plug of an internal combustion engine.

In many forms of coil mounting arrangements wherein the coil is mounted adjacent the spark plug of an internal combustion engine, the coil may be mounted directly on the spark plug. The previously proposed constructions for this purpose have had several disadvantages. In the first instance, the coils have tended to extend above the spark plug and thus increase significantly the height requirements of the engine to clear the spark plug and mounted coil. In addition, the mounting of the spark coil on the spark plug can put undue stress on the spark plug and may, in some instances, cause premature failure of the spark plug.

It is, therefore, a still further object of this invention to provide an improved compact mounting arrangement for the coil of an individual spark plug for an internal combustion engine.

It is a further object of this invention to provide a mounting arrangement for a positioning a coil adjacent a spark plug and wherein the spark plug need not carry the full weight of the coil.

SUMMARY OF THE INVENTION

A first feature of this invention is adapted to be embodied in a spark coil for the spark plug of an internal combustion engine which spark plug has an insulator and a terminal at the end of the insulator. In accordance with this feature of the invention, the spark coil is mounted at least in part by the spark plug and has its entire windings disposed below the terminal of the spark plug when mounted thereon.

Another feature of this invention is also adapted to be embodied in a coil mounting arrangement for the spark plug of an internal combustion engine. In accordance with this feature of the invention, the coil has an interval terminal that mates with the terminal of the spark plug and is mounted at least in part by a mounting device fixed to the engine adjacent the spark plug and independent of the spark plug.

DETAILED DESCRIPTION OF THE PREFERRED EMBODIMENTS OF THE INVENTION

Figure 1:
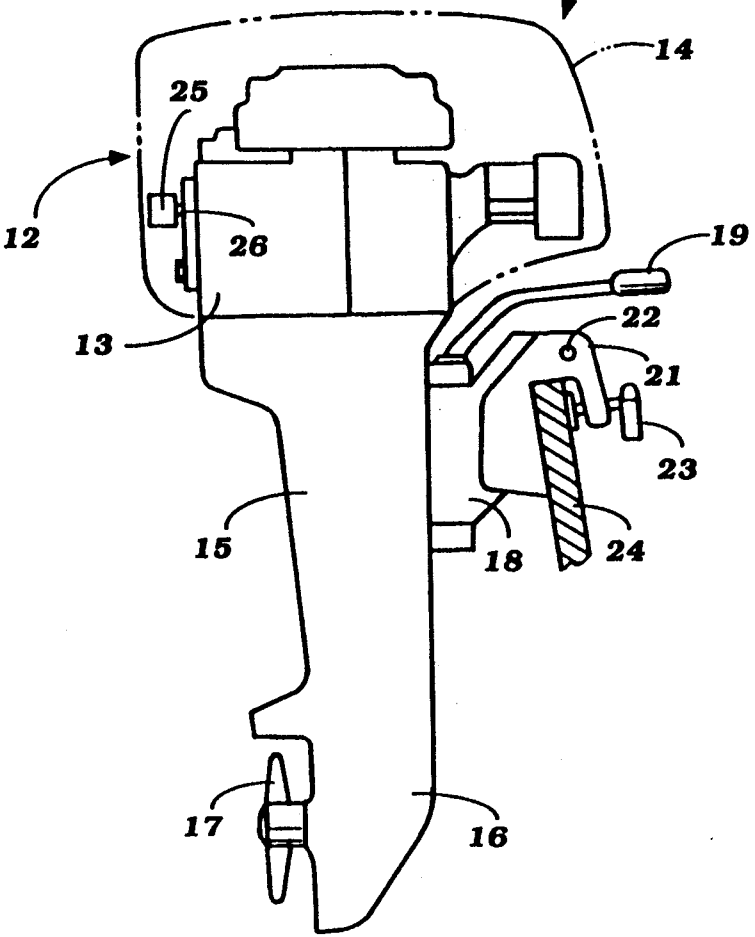
FIG. 1 is a side elevational view of an outboard motor constructed in accordance with a first embodiment of the invention.

Referring first to FIG. 1, an outboard motor constructed in accordance with an embodiment of the invention is identified generally by the reference numeral 11. The invention is described in conjunction with an outboard motor because it has particular utility in such applications. However, it is to be understood that the invention may be utilized in other environments but has particular utility in connection with the ignition system for the spark plugs of an internal combustion engine.

The outboard motor 11 is comprised of a powerhead, indicated generally by the reference numeral 12 that is comprised of an internal combustion engine 13, which may be of any known, spark ignited type, and a surrounding protective cowling which is shown in phantom and which is identified by reference numeral 14. A drive shaft housing 15 depends from the powerhead 12 and contains a drive shaft (not shown) that extends into a lower unit 16 for driving a propeller 17 in a known manner.

A swivel bracket 18 is pivotally connected to a drive shaft housing through a steering shaft (not shown) for steering about a vertically extending steering axis. A tiller 19 is affixed to this steering shaft for steering purposes. The swivel bracket 18 is, in turn, pivotally connected to a clamping bracket 21 by means of a pivot pin 22. The pivotal connection of the swivel bracket 18 to the clamping bracket 21 permits tilt and rim adjustment of the outboard motor 11. The clamping bracket 21 carries a clamping device 23 for affixing the outboard motor 11 to a transom 24 of an associated watercraft.

The construction of the outboard motor 11 as thus far described has been referred to only as a suitable environment in which the invention can be employed. The invention relates specifically to a spark coil, indicated generally by the reference numeral 25 that is mounted on the spark plug 26 of the engine 13 in a manner to be described. It will be understood that there will be one spark coil 25 for each spark plug 26. As may be readily apparent, the configuration of the protective cowling 14 and its relation to the engine 13 that space is at a premium. Therefore, it is very important that the coil 25 be mounted on the spark plug 26 in such a manner as to not significantly increase the overall size of the engine 13 or the spatial requirements.

The construction will now be described by particular reference to FIG. 2. Although this Figure shows a single spark plug 26 and coil 25 associated with it, it is to be understood, as aforenoted, that there will be one such coil and spark plug arrangement for each spark plug of the engine. Normally this will be one spark plug per cylinder although the invention is capable of use with arrangements having multiple spark plugs per cylinder.

Figure 2:
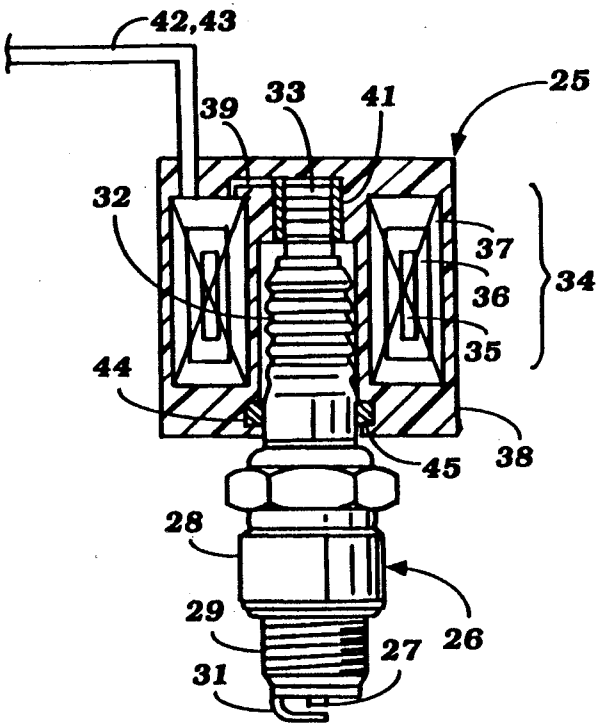
FIG. 2 is an enlarged side elevational view of the spark plug and coil with the coil being shown in cross-section.

Referring now specifically to FIG. 2, it will be noted that the spark plug 26 has a center electrode 27 that is mounted within a mounting base 28 that has a threaded portion 29 for attachment to the head. A grounded electrode 31 cooperates with the center electrode 27 in a known manner.

The center electrode 27 extends through the mounting portion 28 and through a ceramic insulator 32 to terminate in an upper terminal 33 to which the spark wire of a conventional ignition system is normally attached.

In accordance with the invention, the spark coil 25 consists of a main coil portion 34 that is comprised of a core 35, a secondary winding 36 and a primary winding 37 all of which are encased within a plastic insulating case 38. The core 35 and windings 36 and 37 are disposed in an annular or troidal configuration and surround the insulator 32 of the spark plug 26. The secondary winding 36 has a lead 39 that extends to an annular electrode junction 41 that snaps over the terminal 33 to form an electrical connection therewith. Therefore, it will be seen that the entirety of the operative parts of the coil 25 are disposed below the spark plug terminal 33.

A pair of leads 42 and 43 connect the primary and secondary windings 36 and 37 to the ignition control circuit for firing the spark plug 26 at the appropriate time. Since this portion of the ignition circuit forms no part of the invention, it has not been illustrated not is a description of it believed to be necessary.

An elastomeric O-ring 44 is received within an annular groove 45 formed centrally in the insulating housing 38 so as to assist in the location and support of the coil 25 on the spark plug 26.

Figure 4:
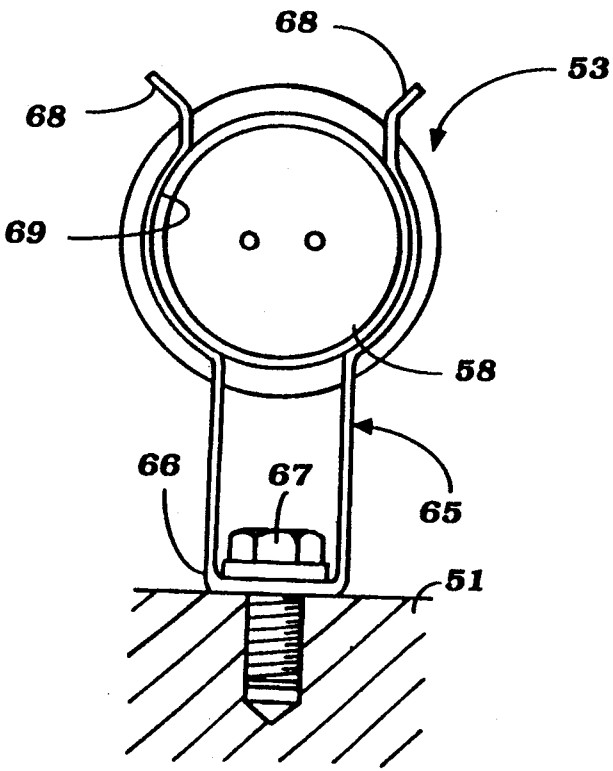
FIG. 4 is an end elevational view of the embodiment of FIG. 3 taken in the direction of the arrow 4 in that Figure.
Figure 3:
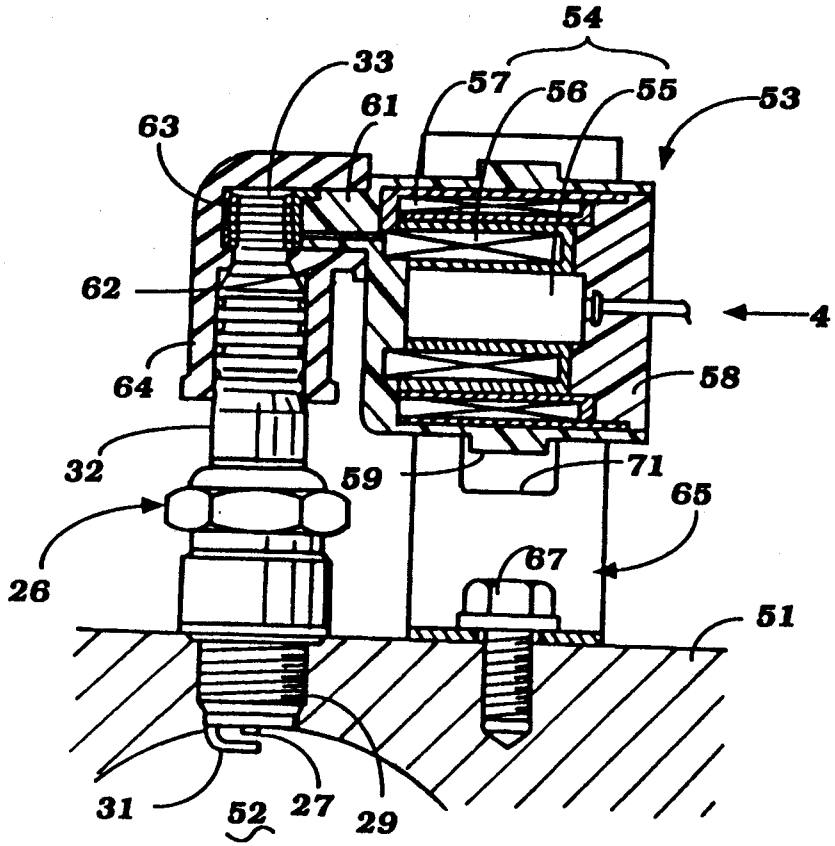
FIG. 3 is a side elevational view in part similar to FIG. 2, showing another embodiment of the invention.

FIGS. 3 and 4 show another embodiment of the invention which is generally similar to the embodiment of FIGS. 1 and 2. In this embodiment, however, an arrangement is provided so as to support at least a part of the weight of the spark coil from a component of the engine other than the spark plug.

Referring now in detail to this embodiment, the spark plug 26 has the same construction as aforedescribed and, for that reason, the spark plug and its components have been identified by the same reference numerals and will not be described again. It should be noted, however, that in the drawings of this embodiment the spark plug threads 29 are shown threaded into a cylinder head 51 of the engine so that the electrodes 27 and 31 will be disposed within the combustion chamber 52, as is well known in this art.

In this embodiment, a spark coil, indicated generally by the reference numeral 53 is disposed so that its coil portion 54 extends perpendicularly to the center electrode 27 of the spark plug 26 rather than coaxially with it as in the previously described embodiment. However, the mounting arrangement, as will become apparent, is such that the operative portion of the coil 54 is disposed below the tip of the electrode terminal 33.

The coil portion 54 is comprised of an core 55, a secondary winding 56 and a primary winding 57. A conductor transmits the suitable power supply and signals to the coil portion 54 for its activation, as aforedescribed.

In this embodiment, an insulating material 58 surrounds the coil 54 and has a generally cylindrical exterior with a cylindrical protrusion 59 at its midpoint. There is further provided an extending portion 61 through which a conductor 62 connects the secondary winding 56 to a terminal 63 that is snap fitted onto the spark plug terminal 33. The terminal 63 and a portion of the housing projecting portion 61 is embedded in a elastic boot 64 for attachment to the spark plug 26 in a known manner.

In order to support at least a substantial portion of the weight of the coil 53, there is provided a mounting bracket, indicated generally by the reference numeral 65 which has a base portion 66 that is held to the cylinder head 51 by means of a threaded fastener 67. The mounting portion 65 has a pair of upwardly extending spring arms 68 that are provided with accurate portions 69 that receive the and yieldably engage the cylindrical portion of the insulator 58 and a central groove 71 in which the projection 59 extends so as to provide axial location and retention.

Figure 6:
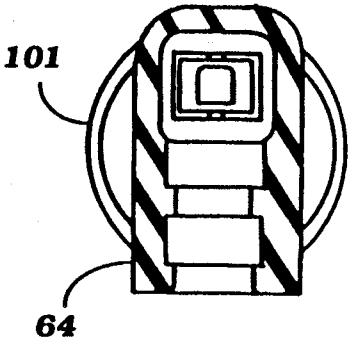
FIG. 6 is a cross-sectional view taken along the line 6—6 of FIG. 5.
Figure 5:
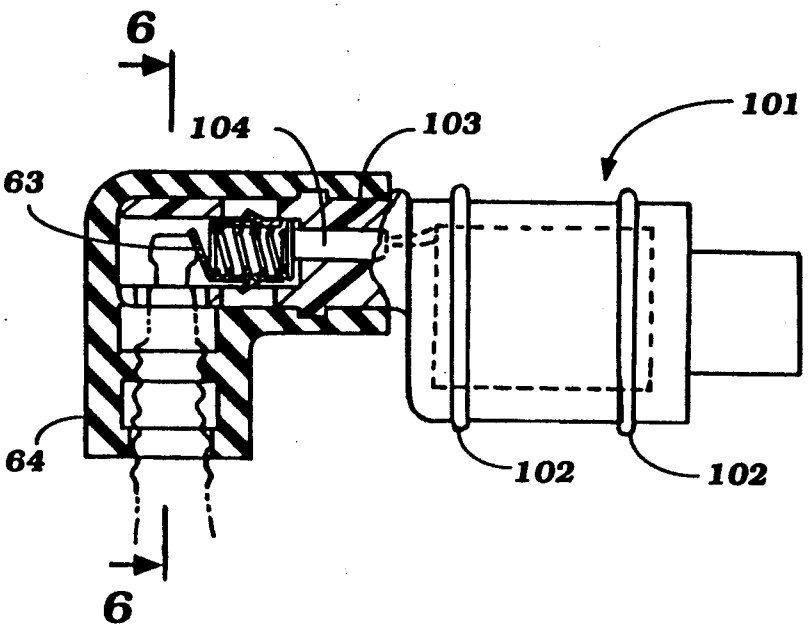
FIG. 5 is a side elevational view in part similar to the previously described embodiments and specifically Figures 2 and 3, showing yet another embodiment of the invention.

FIGS. 5 and 6 show another embodiment of the invention which is generally similar to the embodiment of FIGS. 3 and 4 and which may be mounted in substantially the same way. In this embodiment, the exterior of the coil, indicated generally by the reference numeral 101 is provided with a pair of extending ridges 102 that are adapted to extend around the ends of the bracket 65, which is not shown in this Figure, for location and axial positioning purposes. In this embodiment, the projecting portion 103 of the coil housing incorporates a resistor 104 of a known type for electrical noise suppression. In all other regards, this embodiment is the same as the previously described embodiment and, for that reason, components which are the same or substantially the same have been identified by the same reference numeral and further description of this embodiment is not believed to be required.

In view of the foregoing, it should be readily apparent that several embodiments of the inventions have been illustrated and described each of which provides a very effective coil arrangement for the individual spark plugs of an internal combustion engine that is compact in configuration and does not significantly increase the size requirement for the engine. In addition, some embodiments provide a mounting arrangement for the coil in which the spark plug does not bear the full weight of the coil. Although a number of embodiments of the invention have been illustrated and described, various changes and modifications may be made without departing from the spirit and sculpt of the invention, as defined by the appended claims.

I claim:

1. A cylindrical spark coil for mounting on the spark plug of an internal combustion engine having an insulator and a central electrode having a terminal disposed at an upper end of the insulator, said coil comprising an core, a primary winding and a secondary winding with said secondary winding being provided at the upper end thereof with a terminal adapted to be attached to the terminal of the spark plug, a pair of leads for supplying electrical power to said primary winding, said primary winding, said secondary winding and said armature being substantially entirely disposed below the upper end of the spark plug terminal when attached thereto and the cylindrical axis of said coil extending perpendicularly relative to the center electrode.

2. A spark coil set forth in claim 1 further including means attached to the engine for supporting at least in part the coil independently of the spark plug and of the pair of leads that supplies electrical power to the primary winding.

3. A spark coil as set forth in claim 1 wherein the primary winding, secondary winding, core and spark coil terminal are all contained within a common housing to form a unitary assembly.

4. A spark coil as set forth in claim 10 including means attached to the associated engine cooperating with said outer housing and independently of said spark plug and said pair of leads for supporting the weight of said coil independently of the spark plug.

5. A spark coil as set forth in claim 4 wherein the coil is mounted on the cylinder head of the engine adjacent the spark plug which it serves.

* * * * *